US010234235B2

(12) United States Patent
Higgins

(10) Patent No.: US 10,234,235 B2
(45) Date of Patent: Mar. 19, 2019

(54) CONVERTIBLE HOLSTER-AND-BENCHREST ASSEMBLY

(71) Applicant: Stephen Mark Higgins, Carrollton, TX (US)

(72) Inventor: Stephen Mark Higgins, Carrollton, TX (US)

( * ) Notice: Subject to any disclaimer, the term of this patent is extended or adjusted under 35 U.S.C. 154(b) by 497 days.

(21) Appl. No.: 14/957,240

(22) Filed: Dec. 2, 2015

(65) Prior Publication Data

US 2016/0153747 A1 Jun. 2, 2016

Related U.S. Application Data

(60) Provisional application No. 62/086,564, filed on Dec. 2, 2014.

(51) Int. Cl.

| | |
|---|---|
| ***F41A 23/02*** | (2006.01) |
| ***F41C 33/02*** | (2006.01) |
| *F41A 23/16* | (2006.01) |

(52) U.S. Cl.
CPC ..... *F41C 33/0227* (2013.01); *F41A 23/02* (2013.01); *F41A 23/16* (2013.01)

(58) Field of Classification Search
CPC ..... F41A 23/18; F41A 23/16; F41A 23/02; F41A 23/00; B60R 7/14
USPC ..... 248/500, 346.01; 211/64; 42/94
See application file for complete search history.

(56) References Cited

U.S. PATENT DOCUMENTS

| | | | | |
|---|---|---|---|---|
| 7,159,711 | B1 | 1/2007 | Gardner | |
| 7,584,861 | B2 | 9/2009 | Werner | |
| 8,683,730 | B1 * | 4/2014 | Moore | F41A 23/16 42/94 |
| 9,494,278 | B2 * | 11/2016 | Mantua | F41C 33/041 |
| 9,964,254 | B1 * | 5/2018 | Hayes | F16M 13/02 |
| 2011/0168649 | A1 * | 7/2011 | Stolz | A47B 81/005 211/4 |
| 2013/0086835 | A1 * | 4/2013 | Minneman | F41A 23/16 42/94 |

* cited by examiner

*Primary Examiner* — Steven M Marsh
(74) *Attorney, Agent, or Firm* — Jack D. Stone, Jr.; Scheef & Stone, L.L.P.

(57) ABSTRACT

An apparatus operates as both a holster and a benchrest for a handgun. The apparatus comprises first and second end walls, and a supporting pad secured between the first and second end walls. As a holster, the first and second end walls and the supporting pad define a cradle adapted for holstering a handgun. The holster may also be flipped upside-down and then operated as a benchrest. When the assembly is operating as a benchrest, a barrel rest may be inserted into a barrel-rest receiver slot on the top-side of the assembly. The barrel rest has a U-channel adapted for supporting the barrel of a handgun. The supporting pad further provides a surface for supporting the grip of the handgun.

16 Claims, 4 Drawing Sheets

CONVERTIBLE HOLSTER-AND-BENCHREST ASSEMBLY

CROSS-REFERENCE TO RELATED APPLICATION

This application claims the benefit of U.S. Provisional Application No. 62/086,564, filed Dec. 2, 2014, which application is hereby incorporated herein by reference, in its entirety.

TECHNICAL FIELD

The present invention relates to a convertible holster-and-benchrest assembly, that is, an apparatus that is adapted to holster a handgun and also adapted to operate as a benchrest.

BACKGROUND

Ownership of firearms and personal defense weapons is on the rise. Owners desire to transport their handguns to shooting ranges in order to hone their marksmanship skills. Handguns are typically transported in a holster. Owners often desire to fire their handguns using a benchrest when they are at a shooting range, which steadies the handgun and provides for a more accurate shot, which is particularly important when calibrating the sights on a gun. A benchrest is particularly desirable when a scope is attached to a handgun, particularly if the scope needs to be calibrated also. However, conventional holsters are not capable of holstering a scoped handgun, or require the scope to be removed from the handgun prior to holstering, thereby requiring the owner to re-sight the scope when reattaching the scope. Owners also often forget to bring a benchrest with then to the shooting range or do not desire to transport a cumbersome benchrest with them to the shooting range. Thus, owners often lose the benefits of shooting from a benchrest.

As such, there is a need for a lightweight holster assembly that also provides for a benchrest that can be easily transported with a handgun. It would be desirable if such a holster assembly could holster a scoped handgun. Still further, it would also be desirable for such a holster assembly to be durable, yet capable of being manufactured cost-effectively.

SUMMARY OF THE INVENTION

The present invention provides for an apparatus for holstering a handgun and also operating as a benchrest. The apparatus comprises a first end wall and a second end wall. A barrel rest having a channel adapted to secure a barrel of a handgun when the apparatus is operating as a benchrest is provided. A supporting pad is secured between the first end wall and the second end wall. The supporting pad has a barrel-rest receiver slot adapted to secure the barrel rest when the apparatus is operating as a benchrest. The supporting pad also has a first surface adapted to support a grip-portion of a handgun when the apparatus is operating as a benchrest. The supporting pad also has a second surface adapted to secure a barrel of a handgun when the apparatus is holstering a handgun. The first end wall, the second end wall, and the supporting pad define a cradle adapted to secure a grip-portion of a handgun when the apparatus is holstering a handgun.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
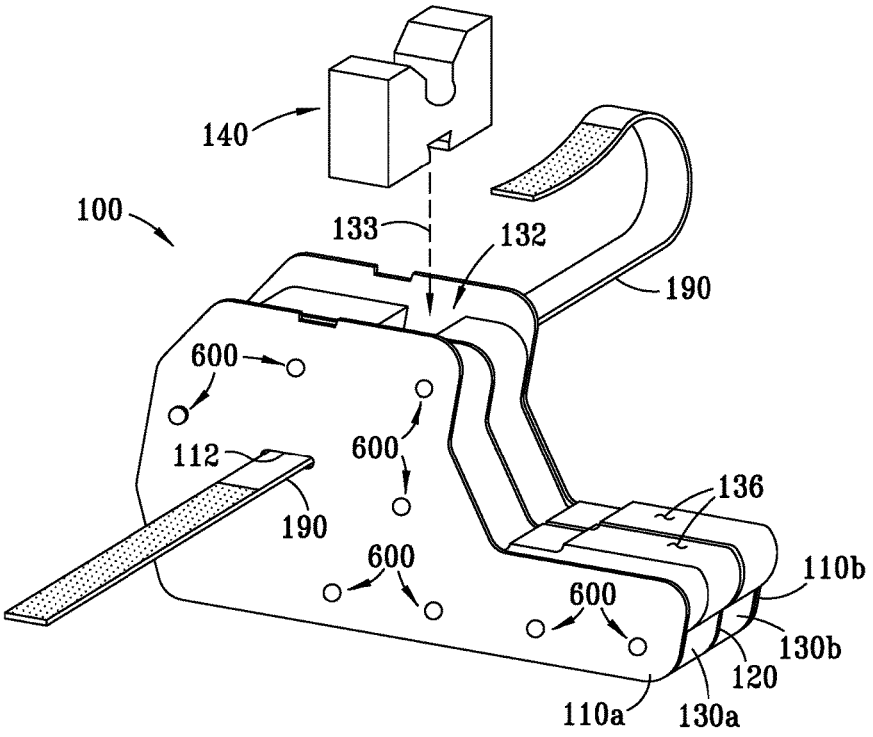
FIG. 1 is an isometric view of a preferred embodiment of a holster assembly in accordance with the present invention exemplified operating as a benchrest.

In the discussion of the FIGURES, the same reference numerals will be used throughout to refer to the same or similar components. In the interest of conciseness, various other components known to the art, such as pistols, mattresses, and the like, have not been shown or discussed in detail. Additionally, as used herein, the term "substantially" is to be construed as a term of approximation. The term handguns as used herein includes handguns, revolvers, Tasers, pistols, stun guns, and the like effective for protection.

Referring to FIG. 1 of the drawings, reference numeral 100 generally designates a holster assembly embodying features of the present invention. Holster assembly 100 is exemplified oriented for operation as a benchrest. Holster assembly 100 comprises end walls 110*a* and 110*b*. Optionally, dividing wall 120 is located between end walls 110*a* and 110*b*. Supporting pad 130*a* is secured between end wall 110*a* and dividing wall 120; while supporting pad 130*b* is secured between end wall 110*b* and dividing wall 120. Surface 136 of each supporting pad is adapted to provide a flat platform for supporting the grip portion of a handgun when holster assembly 100 is operating as a benchrest. Barrel rest 140 is adapted to support a barrel of a handgun when holster assembly 100 is operating as a benchrest.

Barrel-rest receiver slot 132 is formed between walls 110*a*, 110*b*, and 120 and supporting pads 130*a* and 130*b*. Barrel rest 140 inserts into barrel-rest receiver slot 132 as shown by the arrow 133 and thus secured therein. Tube-and-plug fasteners 600, described in further detail below with respect to FIG. 6, secure end walls 110*a* and 110*b*, supporting pads 130*a* and 130*b*, and dividing wall 120 together. Securing means 190, preferably a Velcro® strap, is threaded through a central opening 112 for securing a handgun in place.

Figure 2:
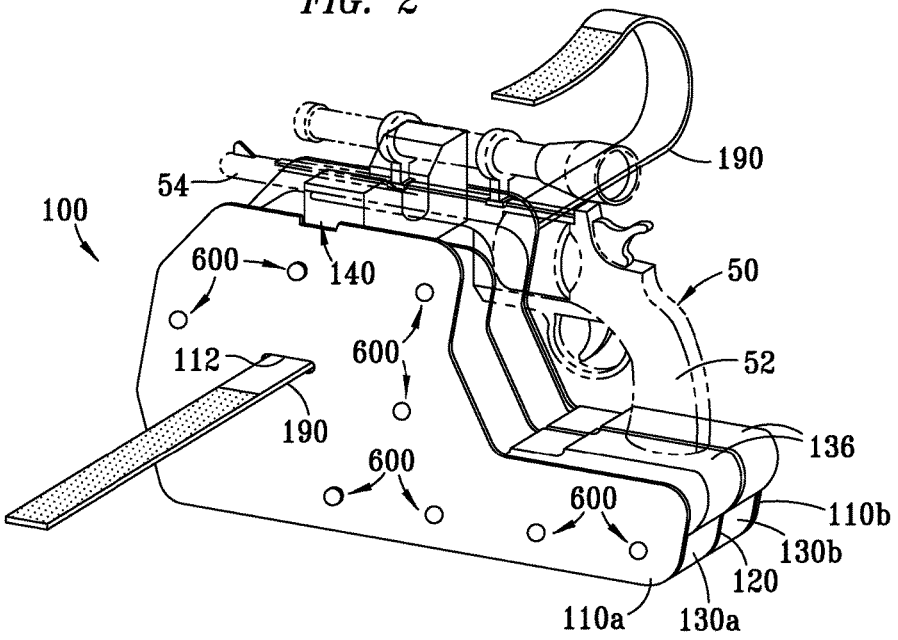
FIG. 2 is an isometric view of the holster assembly exemplified operating as a benchrest and having a handgun oriented in a position for firing.

Referring to FIG. 2, holster assembly 100 is exemplified operating as a benchrest for scoped handgun 50. The grip portion 52 of handgun 50 is supported by surfaces 136 of supporting pads 130*a* and 130*b*. The barrel 54 of handgun 50 is supported by barrel rest 140. It may be appreciated that barrel rest 140 (see FIG. 4A-C) is sized and shaped according to the characteristics (e.g., size and shape) of handgun 50 being fired and, optionally also the desired trajectory of a shot. As such, holster assembly 100 may also be used as a benchrest for a handgun, thereby increasing the accuracy of a shot. This is particularly advantageous when firing a scoped handgun, or sighting the scope of a handgun.

Figure 3:
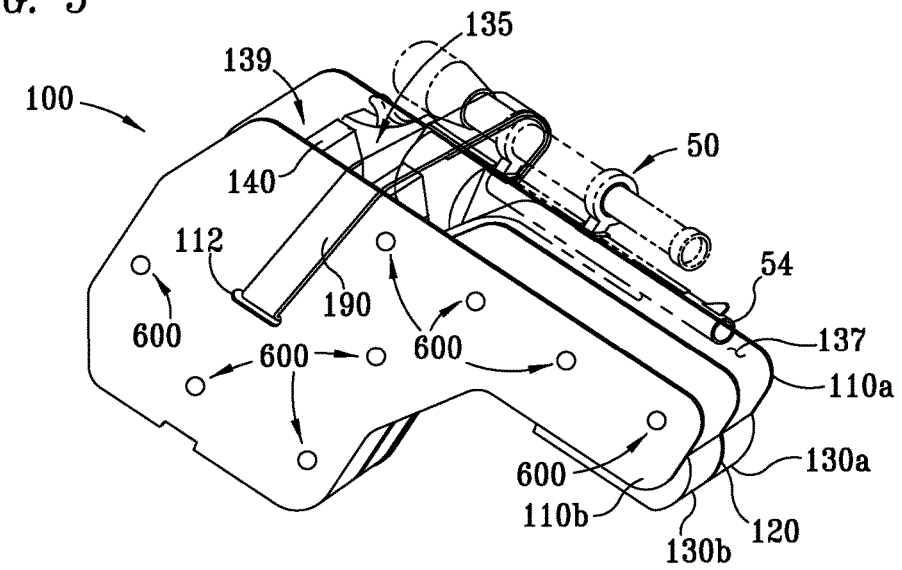
FIG. 3 is an isometric view of the holster assembling exemplified operating as a holster and holstering a scoped handgun.

Referring to FIG. 3, holster assembly 100 is exemplified as holstering scoped handgun 50 in cradle 135, which is defined by supporting pad 130*a*, dividing wall 120, and end wall 110*a*. Cradle 135 is adapted for securing the grip and trigger guard portions of handgun 50. A surface 137 of supporting pad 130*a* is adapted for supporting the barrel of handgun 50. Supporting pad 130*a* also has a flange 138 (see FIG. 5) adapted for securing the heel of handgun 50. Securing means 190, preferably a Velcro® strap, is provided through central opening 112 and may be used to further secure handgun 50 in in place. Securing means 190 may also be flipped around and similarly used to secure a handgun when holster assembly 100 is operating as a benchrest (see FIG. 2). Storage compartment 139 is adapted for storing barrel rest 140 when holster assembly 100 is not operating as a benchrest. Storage compartment 139 is defined by supporting pad 130*b*, dividing wall 120, and end wall 110*b*. As is evident, holster assembly 100 is capable of accommodating a handgun of virtually any size, including a scoped handgun without the need to remove the scope.

Figure 4A:
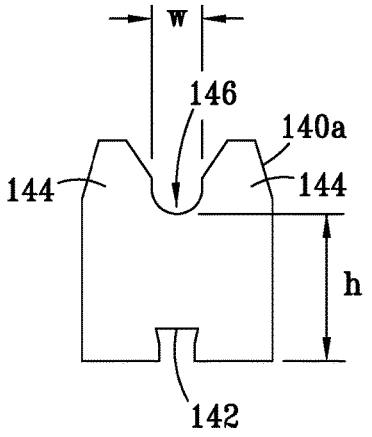
FIGS. 4A-4C are front views of multiple embodiments of a barrel rest in accordance with the present invention.
Figure 4B:
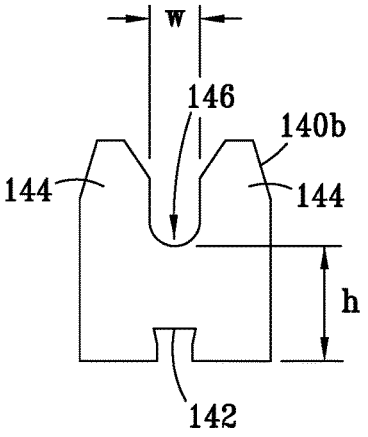
Figure 4C:
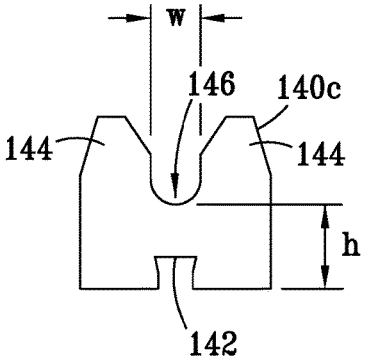

Referring to FIGS. 4A-4C, three embodiments (140*a*, 140*b*, and 140*c*) of barrel rest 140, each of a varying sizes, are provided. Barrel rests 140*a*, 140*b*, and 104*c* each has a horseshoe-shaped or U-shaped upper portion 144 that defines U-channel 146 that is adapted to secure the barrel of a handgun. Height h defines the height channel 146, which determines the vertical elevation of the barrel of a handgun relative to the heel of the handgun. Width w of channel 146 determines the permissible barrel diameters of handguns that may be used with barrel rest 140*a*. By varying h and w, handguns of any size may be used with holster assembly 100 as shown in FIGS. 4A-4C. Barrel rests 140*a*, 140*b*, and 104*c* each has an undercut slot 142 adapted for securing the barrel rest to complementary protrusion 134 formed in supporting pad 130*b* when the barrel rest is stored in storage compartment 139 (see FIG. 5).

Figure 5:
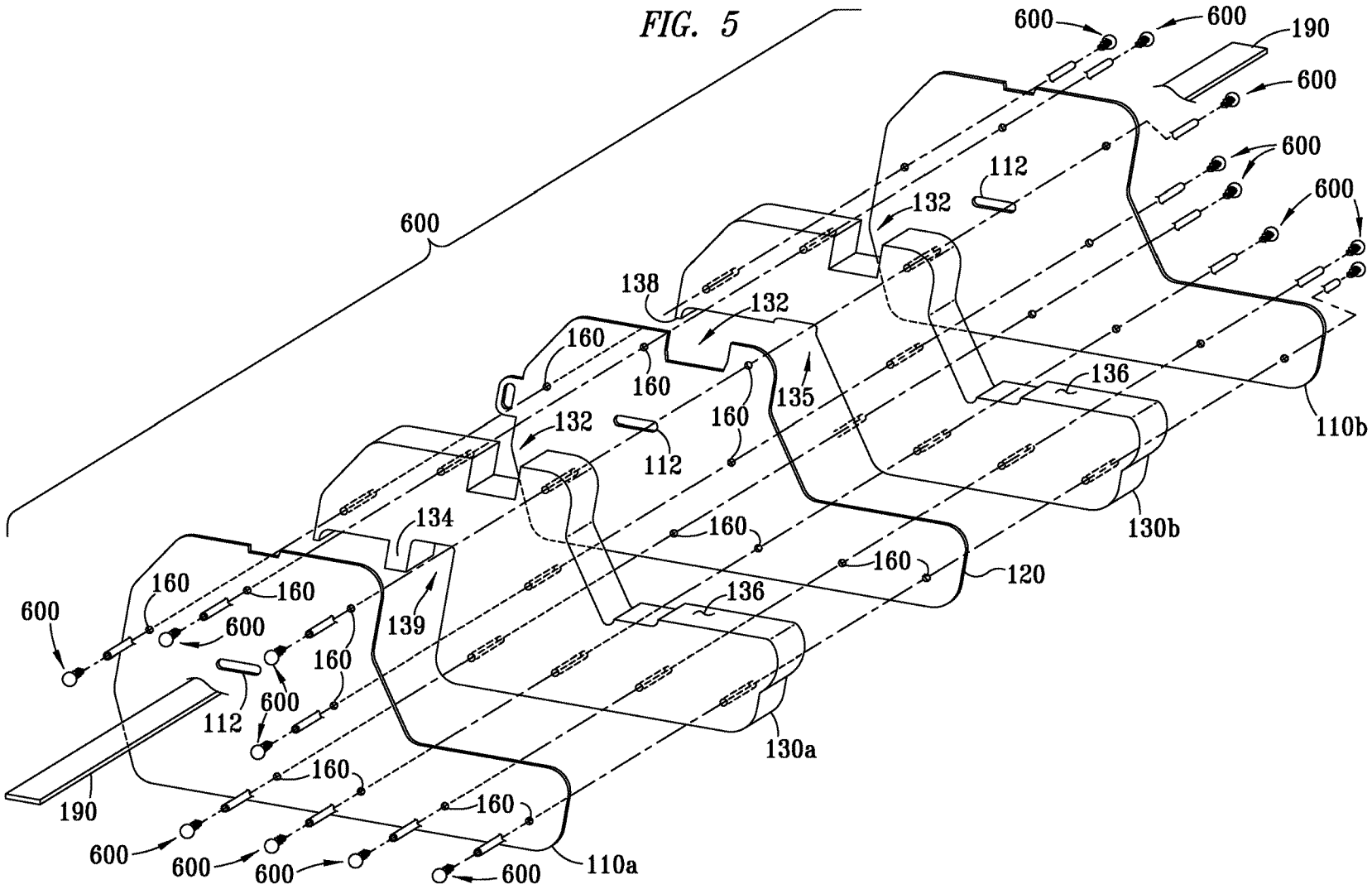
FIG. 5 is an exploded view of the holster assembly.

Referring to FIG. 5, an exploded view of holster assembly 100 is provided. Aligned openings 160 are formed in end walls 110*a* and 110*b*, dividing wall 120, and supporting pads 130*a* and 130*b*. Preferably, tube-and-plug fasteners 600 are inserted through openings 160 during assembly and are used to secure holster assembly 100 together. In alternate embodiments, additional openings 160 are formed and secured by additional fasteners 600, or fewer openings 160 secured by fewer fasteners 600 are provided. Securing means 190 is threaded through central openings 112.

Figure 6:
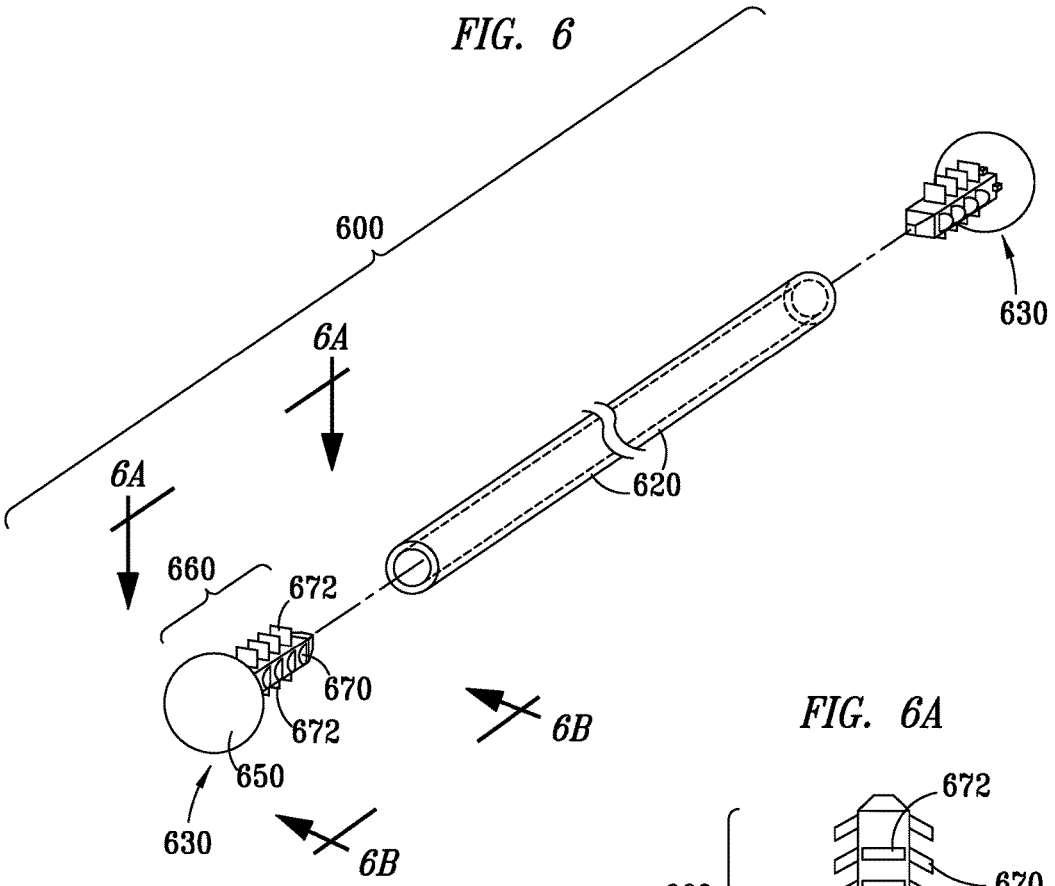
FIG. 6 is an exploded view of an embodiment of a tube-and-plug fastener in accordance with the present invention.
Figure 6A:
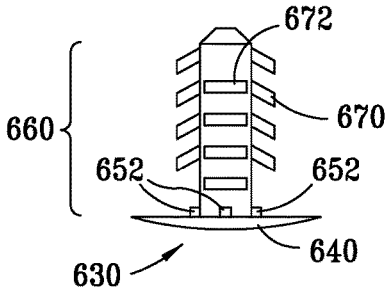
FIG. 6A is a side view of a plug in accordance with a preferred embodiment of the present invention taken along view line 6A-6A.
Figure 6B:
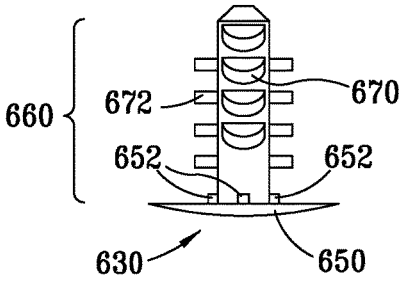
FIG. 6B is a side view of the plug taken along view line 6B-6B.

Referring to FIGS. 6, 6A, and 6B, a preferred embodiment of a tube-and-plug fastener 600 is provided. Tube-and-plug fastener 600 comprises tube 620 and plugs 630. In a preferred embodiment, tube 620 is fabricated from plastic, such as polyethylene, with an outside diameter, by way of example but not limitation, of approximately 0.25 inches (0.6 cm). The length of tube 620 is determined by the width of the components being secured as discussed below. Plugs 630 are used to secure the ends of tube 620 against end walls 110*a* and 110*b*. Each plug 630 has a head 650 and a rectangular body 660. Strengthening pillars 652 are preferably provided where head 650 couples to body 660. Strengthening pillars 652 are advantageous as they strengthen the structural integrity of plug 630, while conserving material used to fabricate plug 630 and providing for a tighter fit between plug 630 and end wall 110*a* or 110*b* being secured thereto. Body 660 has angled ribbing 670 and straight ribbing 672 adapted for allowing insertion of body 660 into the end of tube 620, but for resisting removal of body 660 from the tube. Plugs 630 are preferably injection molded from plastic, such as polypropylene.

Figure 6C:
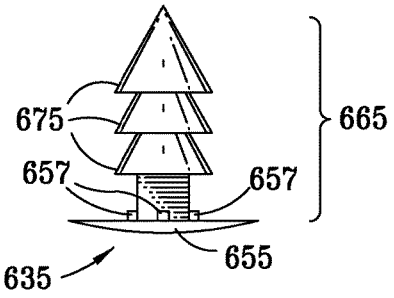
FIG. 6C is a side view of a plug in accordance with an alternate embodiment of the present invention.

Referring to FIG. 6C, plug 635 is provided in accordance with an alternate embodiment of the present invention. Plugs 635 may be used to secure the ends of tubes 620 (see FIG. 6). Each plug 635 has a head 655 and a cylindrical body 665. Strengthening pillars 657 are provided where head 655 couples to body 665. Strengthening pillars 657 are advantageous as they strengthen the structural integrity of plug 635, while conserving material used to fabricate plug 635 and providing for a tighter fit between plug 635 and an end wall 110*a* or 110*b* being secured thereto. Body 665 has conical ribbing 675 adapted for allowing insertion of body 665 into the end of tube 620, but for resisting removal of body 665 from the tube. Plugs 635 are preferably injection molded from plastic, such as polypropylene.

In the assembly of the holster assemblies described above, supporting pads 130*a* and 130*b* are preferably fabricated form a suitable sheet of semi-rigid, closed-cell type of foam, such as a polyethylene foam. The sheet of foam preferably has a thickness suitable for forming cradle 135 sized for receiving and holding a selected handgun. The sheet of foam is then suitably cut, preferably using a water jet cutter, to form respective supporting pads. Thus, each supporting pad is preferably fabricated from a single, unitary piece of foam. Barrel rests 140 are similarly fabricated, preferably from a single unitary piece of foam.

End walls 110*a* and 110*b* and dividing wall 120 are preferably cut from a sheet of tough plastic, or thermoplastic, such as acrylonitrile butadiene styrene (ABS), using a water jet cutter. The sheet of plastic preferably has a thickness sufficient to provide desired vertical and transverse structural support, yet flexible enough to bend when a lateral force is applied. This allows for handguns of different widths to be stored in holster assembly 100, including handguns whose widths exceed the width of cradle 135. For example, a revolver having a cylinder wider than the cradle can be accommodated as end wall 110*a* and dividing wall 120 are capable of flexing. As such, the handgun assembly has the benefit of accommodating virtually any sized handgun.

Holster assembly 100 is preferably secured using tube-and-plug fasteners 600. Openings 160 are formed in walls 110*a* and 110*b*, dividing wall 120, and supporting pads 130*a* and 130*b*. Openings 160 are preferably formed using a water jet cutter. In a preferred embodiment, openings 160 are preferably approximately 0.25 inches (0.6 cm) in diameter. Tubes 620 are first inserted into each set of aligned openings 160. After securing a first end of each tube 620 using plug

630 (or any other means, such as plug 635), the components of holster assembly 100 are urged into their proper position along tubes 620. The tubes are not pre-cut to precisely the needed length. Instead, each tube is initially cut to a length slightly longer than the anticipated width of the finished holster assembly. As such, the unplugged ends of tubes 620 protrude out from openings 160 in the component that is farthest from the plugged ends of tubes 620. The excess portions of tubes 620 are then removed using a tool, e.g., a razor blade. Plugs 630 are then inserted into the unplugged ends of tubes 620. When plugs 630 are inserted into the ends of tubes 620, the ends are enlarged. This enlargement urges the ends of tubes 620 against the opening in end walls 110*a* and 110*b*, which provides additional friction to secure the holster assembly together. Furthermore, with the length of tubes 620 substantially the width of holster assembly 100, heads 650 of plugs 630 urge against the exterior surface of end wall 110*a* and 110*b*, thereby providing additional structural stability.

The method of securing holster assembly 100 in accordance with the principles of the present invention provides a number of advantages not seen in the prior art. For example, it is particularly useful because the width of each component (e.g., the foam supporting pads) may vary by, for example, as much as ⅛ of an inch, which causes the width of the entire holster assembly to vary. If tubes 620 were precisely cut before assembly, some tubes would be too long or too short. Cutting tubes 620 after inserting them into the holster assembly ensures that each tube will be substantially the correct length for a particular holster assembly. This allows the components (e.g., the foam supporting pads) to be cut using less expensive techniques, thus reducing manufacturing costs.

The use of plastics and foam provides further advantages of a strong, yet lightweight, holster assembly 100. In particular, lightweight foam is preferably used for larger components, such as supporting pads 130*a* and 130*b*. Stronger thermoplastic is preferably used for end walls 110*a* and 110*b*, dividing wall 120, and fasteners, which collectively provide rigidity in all three dimensions and prevents foam supporting pads 110*a* and 110*b* from being crushed. Moreover, in a preferred embodiment, the present invention does not require any metal components, which are not only more costly but may also scratch or damage a handgun. Still further, preferred embodiments also avoid the use of adhesives, which can deteriorate over time and potentially damage a handgun.

It is understood that the present invention may take many forms and embodiments. Accordingly, several variations may be made in the foregoing without departing from the spirit or the scope of the invention. For example, additional dividing walls 120 and supporting pads 130*a*/130*b* could be added to store additional handguns. Alternatively, dividing wall 120 or one of supporting pads 130*a* or 130*b* could be omitted. The shape of the walls and support pads could be configured in alternative ways, e.g., the central portions of supporting pads 130*a*/130*b* and/or walls 110 and 120 could be cutout to reduce material costs and to reduce weight of a finished holster assembly.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. An apparatus for holstering a handgun and also operating as a benchrest, the apparatus comprising:

a first end wall and a second end wall;

a barrel rest defining a channel adapted to secure a barrel of a handgun when the apparatus is operating as a benchrest;

a supporting pad secured between the first end wall and the second end wall, the supporting pad having:

a barrel-rest receiver slot adapted to receive and secure the barrel rest when the apparatus is operating as a benchrest, a first surface adapted to urge against a grip-portion of a handgun when the apparatus is operating as a benchrest, and a second surface adapted to urge against a barrel of a handgun when the apparatus is holstering a handgun; and the first end wall, the second end wall, and the supporting pad defining a cradle adapted to secure a grip-portion of a handgun when the apparatus is holstering a handgun.

2. The apparatus of claim 1, wherein the first end wall, the second end wall, and the supporting pad are secured using one or more tube-and-plug fasteners, each of the one or more tube-and-plug fasteners comprising a tube defining two ends, each end of which is secured with a plug.

3. The apparatus of claim 1, wherein:

the first end wall, the second end wall, and the supporting pad are secured using one or more tube-and-plug fasteners, each of the one or more tube-and-plug fasteners comprising a tube defining two ends, each end of which is secured with a plug; and each plug defines ribs for enabling the plug to be readily inserted into an end of the tube, but to resist removal from the end of the tube.

4. The apparatus of claim 1, wherein:

the first end wall, the second end wall, and the supporting pad are secured using one or more tube-and-plug fasteners, each of the one or more tube-and-plug fasteners comprising a tube defining two ends, each end of which is secured with a plug; and each tube is a hollow, cylindrical plastic tube.

5. The apparatus of claim 1, wherein:

the first end wall, the second end wall, and the supporting pad are secured using one or more tube-and-plug fasteners, each of the one or more tube-and-plug fasteners comprising a tube defining two ends, each end of which is secured with a plug; and each tube is a hollow, cylindrical plastic tube having a diameter between about ⅛ inches and about ¼ inches.

6. The apparatus of claim 1, wherein the supporting pad is a first supporting pad, and wherein the apparatus further comprises:

a dividing wall secured between the first supporting pad and the second end wall;

a second supporting pad positioned between the dividing wall and the second end wall; and wherein the second supporting pad, the dividing wall, and the second end wall define a storage compartment adapted to secure the barrel rest.

7. The apparatus of claim 1, wherein the supporting pad is a first supporting pad, and wherein the apparatus further comprises:

a dividing wall located between the first supporting pad and the second end wall;

a second supporting pad positioned between the dividing wall and the second end wall;

the second supporting pad, the dividing wall, and the second end wall define a storage compartment adapted to secure the barrel rest;

wherein the barrel rest defines an undercut slot; and wherein the second supporting pad includes a protrusion adapted to urge against the undercut slot when the barrel rest is stored the storage compartment.

8. The apparatus of claim 1, wherein the supporting pad further comprises a flange adapted to secure a heel portion of a handgun.

9. The apparatus of claim 1, wherein the first end wall and the second end wall have an aligned opening adapted to receive a strap for securing a handgun to the apparatus.

10. The apparatus of claim 1 further comprising means for securing a handgun to the apparatus.

11. The apparatus of claim 1 further comprising a strap configured to secure a handgun to the apparatus.

12. The apparatus of claim 1, wherein the supporting pad is made from polyethylene foam.

13. The apparatus of claim 1, wherein the first end wall and the second end wall are made from acrylonitrile butadiene styrene (ABS).

14. A method for assembling an apparatus for holstering a handgun and also operating as a benchrest, the method comprising the steps of:

cutting a first and second end wall from a sheet of plastic;

cutting a supporting pad from a sheet of foam, wherein the supporting pad comprises:

a slot adapted to secure a barrel rest when the apparatus is operating as a benchrest, a first surface adapted to support a grip-portion of a handgun when the apparatus is operating as a benchrest, and a second surface adapted to secure a barrel of a handgun when the apparatus is holstering a handgun; and forming an aligned opening through the supporting pad and the first and second end walls;

extending a hollow plastic tube through the aligned openings;

urging the first end wall, the second end wall, and the supporting pad into position along the tube;

cutting an end of the tube to a length equal to an approximate length of the opening through the supporting pad and the first and second end walls; and inserting a plug into each end of the plastic tube.

15. The method of claim 14, wherein the plug defines ribs for enabling the plug to be readily inserted into an end of the tube, but to resist removal from the end of the tube.

16. A product made by the method of claim 14.

* * * * *